US005095202A

United States Patent [19]

Watase et al.

[11] Patent Number: 5,095,202

[45] Date of Patent: Mar. 10, 1992

[54] PROXIMITY IMAGE INTENSIFIER

[75] Inventors: Yasushi Watase; Toshio Ikuma, both of Hamamatsu, Japan

[73] Assignee: Hamamatsu Photonics K.K., Shizuoka, Japan

[21] Appl. No.: 670,102

[22] Filed: Mar. 15, 1991

[30] Foreign Application Priority Data

Mar. 15, 1990 [JP] Japan ..... 2-64600

[51] Int. Cl.[5] ..... H01J 31/50

[52] U.S. Cl. ..... 250/213 VT; 313/526

[58] Field of Search ..... 250/213 VT; 313/526, 313/530, 541, 544

[56] References Cited

U.S. PATENT DOCUMENTS

| | | | |
|---|---|---|---|
| Re. 29,233 | 5/1977 | Cuelenaere et al. | 250/213 VT |
| 3,619,496 | 11/1971 | Lichtenstein | 250/313 VT |
| 4,087,683 | 5/1978 | Lieb | 250/213 VT |
| 4,243,905 | 1/1981 | van Geest et al. | 313/102 |
| 4,422,008 | 12/1983 | Aramaki et al. | 250/215 |
| 4,755,718 | 7/1988 | Patrick | 313/526 |

FOREIGN PATENT DOCUMENTS

| | | |
|---|---|---|
| 2081965 | 2/1982 | United Kingdom . |
| 2081966 | 2/1982 | United Kingdom . |

*Primary Examiner*—Janice A. Howell
*Assistant Examiner*—Kiet T. Nguyen
*Attorney, Agent, or Firm*—Sughrue, Mion, Zinn, Macpeak & Seas

[57] ABSTRACT

A proximity image intensifier for use in a light amplifier in a high-sensitivity hand-held camera for broadcasting service or the like, which includes a photocathode for photoelectrically converting an optical image, a phosphor screen for receiving photoelectrons from the photocathode and producing an intensified optical image, and a high-voltage power supply for applying a high voltage across the photocathode and the phosphor screen. For protecting the phosphor screen from burn-out due to a spot of incident light, a resistor is interposed in a power supply path at a position immediately before at least one of the photocathode and the phosphor screen to reduce an electrostatic capacitance between the photocathode and the phosphor screen.

10 Claims, 2 Drawing Sheets

PROXIMITY IMAGE INTENSIFIER

BACKGROUND OF THE INVENTION

The present invention relates to a proximity image intensifier for use in a light amplifier in a high-sensitivity hand-held camera for broadcasting service or a device for providing night vision.

As shown in FIGS. 1A and 1B, a conventional proximity image intensifier includes a photocathode 10 and a phosphor screen 12 which are disposed closely to each other in a vacuum. A high voltage of 9 kV, for example, is applied from a high-voltage power supply 14 between the photocathode 10 and the phosphor screen 12 through a high resistor 16, and flanges 18, 20, 22, 24 to accelerate the velocity of the photoelectrons emerging from the photocathode 10 dependent upon the incident of optical image thereon. Under the applied high voltage, an optical image entered into the photocathode 10 is intensified and reproduced on the phosphor screen 12. The resistor 16 has a high resistance ranging from 1 GΩ to 30 GΩ. The resistor 16 is provided to limit the undue flow of current between the photocathode 10 and the phosphor screen 12 which may occur in an accidental dielectric breakdown therebetween. The resistor 16 further serves to suppress a flow of photoelectrons which are produced when highly intensive light such as flash light falls on the photocathode 10, so that the photocathode 10 and the phosphor screen 12 are prevented from being damaged.

The high resistor 16 in the conventional image intensifier shown in FIGS. 1A and 1B is capable of blocking a photoelectron beam for the protection of the photocathode 10 and the phosphor screen 12 from burnout when highly intensive light such as flash light falls widely over the photocathode 10. However, when intensive incident light is applied only to a small area (e.g., a spot which is 1 mm across) on the photocathode 10, the entire flow of generated photoelectrons is not so large though a localized density of photoelectrons is increased. Therefore, the high resistor 10 is not effective for such an instance, causing to locally burn out the phosphor screen 12.

Research has been conducted to determine possible causes of such a burnout on the phosphor surface 12. Heretofore, the outside diameter of the photocathode 10 is substantially equal to the inside diameter of the flange 18, and the photocathode 10 and the flange 18 are coupled to each other by an electrically conductive layer 21. Consequently, a large substantial electrostatic capacitance C is developed between the photocathode 10 and the phosphor screen 12. It has been found that the electric charge Q (=CV) stored by the electrostatic capacitor C is one of the causes of the burnout. The electrostatic capacitance C is composed of not only the electrostatic capacitance between the photocathode 10 and the phosphor screen 12, but also the electrostatic capacitance between the flanges 18, 20 and 22, 24. Since the size of the photocathode 10 is much larger than the area of an effective portion 10*a* thereof, the electrostatic capacitance C has a large value of 8 pF, for example.

SUMMARY OF THE INVENTION

In view of the above problems of the conventional image intensifier, it is an object of the present invention to provide a proximity image intensifier which has a reduced electrostatic capacitance between a photocathode and a phosphor screen, for protecting the photocathode and the phosphor screen from burnout due to a spot of incident light, which burnout has not heretofore been prevented by the conventional high resistor for suppressing a photoelectric current.

According to the present invention, there is provided a proximity image intensifier for intensifying an optical image on a photocathode to reproduce the image on a phosphor screen by applying a voltage from a high-voltage power supply between the photocathode and the phosphor screen which are positioned closely to each other, the proximity image intensifier comprising a resistor for suppressing an excessive photoelectric current, the resistor being inserted in a power supply path for applying the high voltage from the high-voltage power supply between the photocathode and the phosphor screen, at a position immediately before at least one of the photocathode and the phosphor screen. To further reduce the substantial electrostatic capacitance between the photocathode and the phosphor screen, the photocathode has an area slightly larger than an effective portion thereof for photoelectrically converting the optical image.

When the high voltage from the high-voltage power supply is applied between the photocathode and the phosphor screen, a flow of photoelectrons generated in response to an optical image falling on the photocathode is accelerated and the photoelectrons with increased energy impinge upon the phosphor screen, so that an image which is brighter than the incident optical image is reproduced on the phosphor screen. The resistor for suppressing an excessive photoelectric current is inserted in the power supply path for applying the high voltage at the position immediately before at least one of the photocathode and the phosphor screen, for thereby eliminating the effect of the electrostatic capacitance between flanges. Accordingly, the substantial electrostatic capacitance between the photocathode and the phosphor screen is made smaller than the conventional electrostatic capacitance which has also included the electrostatic capacitance between the flanges. The charge stored by the electrostatic capacitance is also reduced, so that the photocathode and the phosphor screen are protected from burnout that would otherwise be caused by a spot of intensive light incident on the photocathode. In the case where the area of the photocathode is slightly larger than the effective portion thereof for photoelectrically converting the applied optical image, so that the area is smaller than the conventional area, the electrostatic capacitance between the photocathode and the phosphor screen is further reduced for the reliable prevention of burnout of the photocathode and the phosphor screen in the event of a spot of intensive light falling on the photocathode.

DETAILED DESCRIPTION OF THE PREFERRED EMBODIMENTS

Figure 1A:
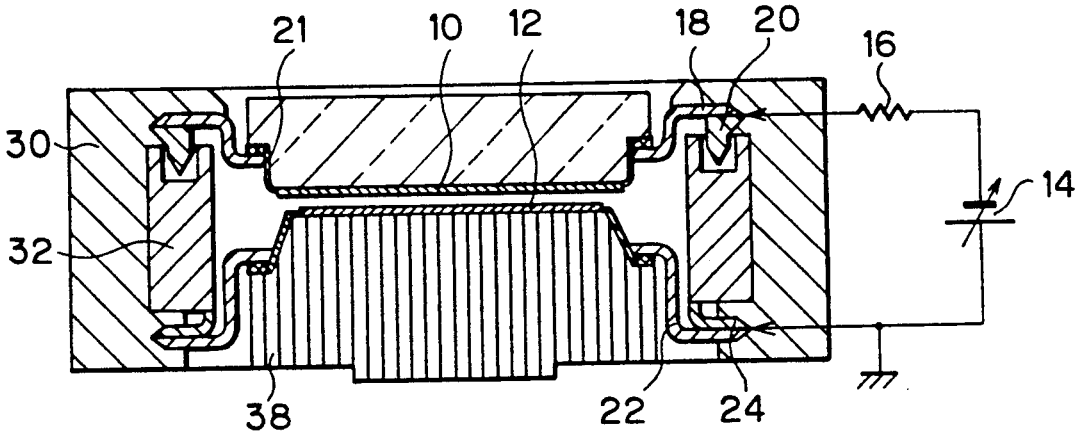
FIG. 1A PRIOR ART
FIG 1A is a cross-sectional view showing a conventional proximity image intensifier.
Figure 1B:
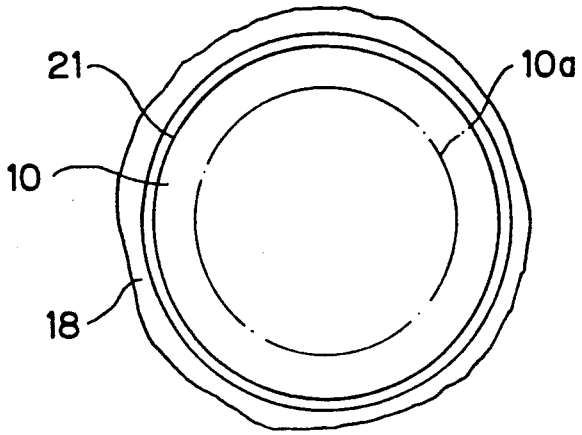
FIG. 1B PRIOR ART
FIG. 1B is a fragmentary plan view showing a photocathode of the conventional proximity image intensifier.
Figure 2A:
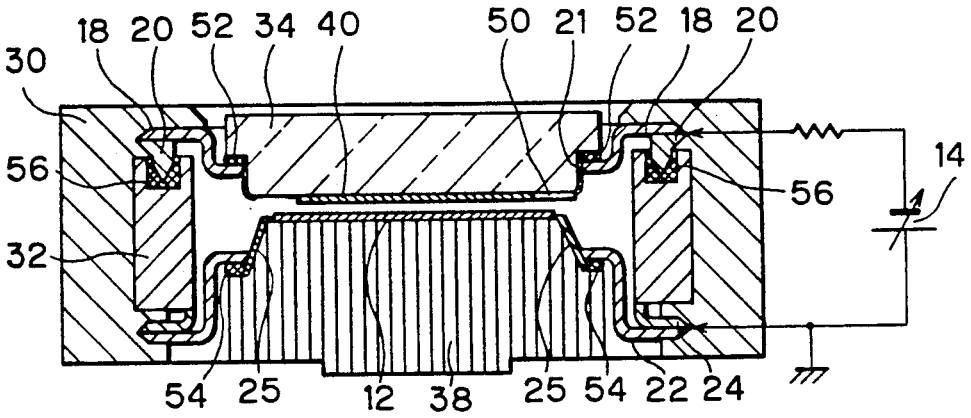
FIG. 2A is a cross-sectional view showing a proximity image intensifier according to an embodiment of the present invention.
Figure 2B:
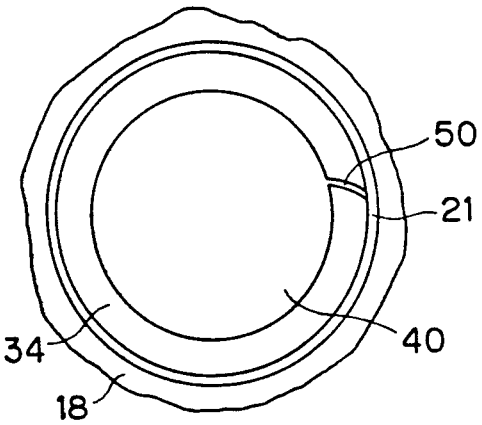
FIG. 2B is a fragmentary plan view showing a photocathode viewed from a phosphor screen of the proximity image intensifier shown in FIG. 2A.

FIGS. 2A and 2B show an embodiment of the present invention. Those parts shown in FIGS. 2A and 2B which are identical to those shown in FIGS. 1A and 1B are denoted by identical reference numerals. As shown in FIGS. 2A and 2B, an image intensifier includes a cylindrical casing 30 of an insulating material. The casing 30 houses therein a cylindrical insulating side tube 32 of ceramic which is evacuated. Metal flanges 18, 20 which double as a high-voltage connector terminal, are hermetically attached to one axial end of the side tube 32 through seals 56 of indium. A glass-formed faceplate 34 is also hermetically mounted centrally in the end of the side tube 32 radially inwardly of the flange 18 by seals 52 of flint glass. A photocathode 40 is fixed to an inner surface of the faceplate 34. A resistor 50 having a resistance of 1 GΩ, for example, for suppressing an excessive photoelectric current and an electric conductive layer 21 are inserted and connected between the photocathode 40 and the flange 20. Metal flanges 22, 24 which double as a ground connector terminal are attached to the other axial end of the side tube 32. A fiberplate 38 of glass is hermetically mounted centrally in the other end of the side tube 32 radially inwardly of the flange 22 through seals 54 of frit glass. A phosphor screen 12 is fixed to an inner surface of the fiberplate 38 and electrically connected to the flanges 22, 24 by an electrically conductive layer 25. The flanges 18, 20 are connected to a negative terminal of a high-voltage power supply 14, whereas the flanges 22, 24 are connected to a positive terminal of the high-voltage power supply 14 and also to ground.

The photocathode 40 and the resistor 50 are integrally deposited on the surface of the faceplate 34 by evaporation or the like. More specifically, a multi-alkaline photoelectric layer (Sb-Na-K-Cs) whose spectral sensitivity is of S-20 characteristics is deposited on the surface of the faceplate 34 by evaporation or the like through a mask. The deposited photoelectric layer includes a circular region and a very narrow joint which are provided by the correspondingly shaped mask. The circular region of the deposited photoelectric layer serves as the circular photocathode 40 which is slightly larger than the effective portion for photoelectrically converting the applied optical image. The very narrow joint of the deposited photoelectric layer serves as the resistor 50 by which the photocathode 40 is connected to the flange 20 through the electrically conductive layer 21.

Operation of the image intensifier according to the above embodiment will be described below.

When a high voltage of 9 kV, for example, is applied from the high-voltage power supply 14 between the photocathode 40 and the phosphor screen 12, a photoelectron beam generated in response to an optical image falling on the photocathode 40 is accelerated and the photoelectrons with increased energy impinge upon the phosphor screen 12, so that an image which is brighter than the incident optical image is reproduced on the phosphor screen 12. The resistor 50 for suppressing an excessive photoelectric current is inserted in the power supply path for applying the high voltage at the position immediately before the photocathode 40, for thereby blocking the effect of the electrostatic capacitance between flanges 18, 20 and 22, 24. Accordingly, the electrostatic capacitance between the photocathode 40 and the phosphor screen 12 is made smaller than the conventional electrostatic capacitance which has also included the electrostatic capacitance between the flanges 18, 20 and 22, 24. Furthermore, the area of the photocathode 40 as seen from the phosphor screen 12 is slightly larger than the effective portion thereof for photoelectrically converting the applied optical image, as shown in FIGS. 2A and 2B, so that the area is smaller than the conventional area shown in FIGS. 1A and 1B. Thus, the electrostatic capacitance between the photocathode 40 and the phosphor screen 12 is further reduced. Therefore, the substantial electrostatic capacitance C between the photocathode 40 and the phosphor screen 12 is greatly reduced for the reliable prevention of burnout of the phosphor screen 12 in the event of a spot of intensive light falling on the photocathode 40.

According to actual measurements, the electrostatic capacitance C developed between the photocathode 40 and the phosphor screen 12 was 2 pF, the photocathode 40 being of an area smaller than the area of the conventional photocathode 10 and slightly larger than the effective portion for photoelectrically converting the applied optical image. The electrostatic capacitance C between the conventional photocathode 10 and the phosphor screen 12 as shown in FIGS. 1A and 1B was 8 pF. Consequently, with the resistor 50 for suppressing an excessive photoelectric current being inserted immediately before the photocathode 40, the substantial electrostatic capacitance C between the photocathode 40 and the phosphor screen 12 is slightly greater than 2 pF, but is reduced approximately to $\frac{1}{4} \propto$ of the conventional electrostatic capacitance.

Figure 2C:
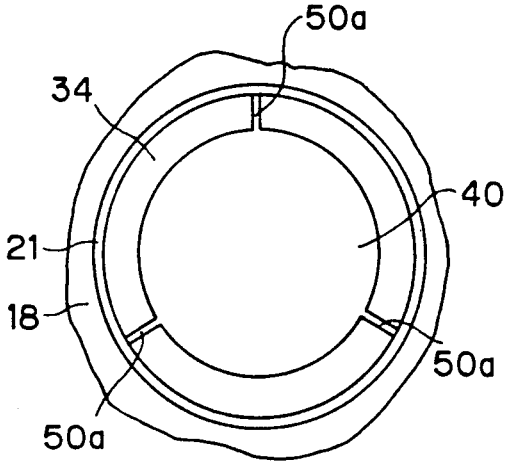
FIG. 2C is a fragmentary plan view showing a photocathode viewed from a phosphor screen of a proximity image intensifier according to another embodiment of the present invention.

In the above embodiment, the photocathode is smaller than the conventional photocathode so as to be substantially equal to the effective portion, with a single very narrow joint left around the photocathode. The very narrow joint serves as the resistor for suppressing an excessive photoelectric current. However, the present invention is not limited to the above construction. The resistor for suppressing an excessive photoelectric current may be inserted in the power supply path for applying a high voltage from the high-voltage power supply to the photocathode at a position immediately before the photocathode. For example, as shown in FIG. 2C, a multialkaline photoelectric layer (Sb-Na-K-Cs) whose spectral sensitivity is of S-20 characteristics may be deposited on the surface of the glass substrate of the faceplate 34, and a circular region of the deposited multialkaline photoelectric layer which is slightly larger than an effective portion for photoelectrically converting an applied optical image may be employed as the photocathode 40, which may be connected to the flange 18 through the electrically conductive layer 21 and three very narrow joints serving as resistors 50*a*. Alternatively, the circular region of the deposited photoelectric layer, which serves as the photocathode 40, may be surrounded by a thinner photoelectric layer serving as a resistor for suppressing an excessive photoelectric current. As a further alternative, a resistor for suppressing an excessive photoelectric current may be provided separately from the photocathode. For example, a resistive layer or wire which is made of a material different from that of the photocathode may be disposed radially outwardly of the photocathode as a resistor for suppressing an excessive photoelectric current.

Figure 3:
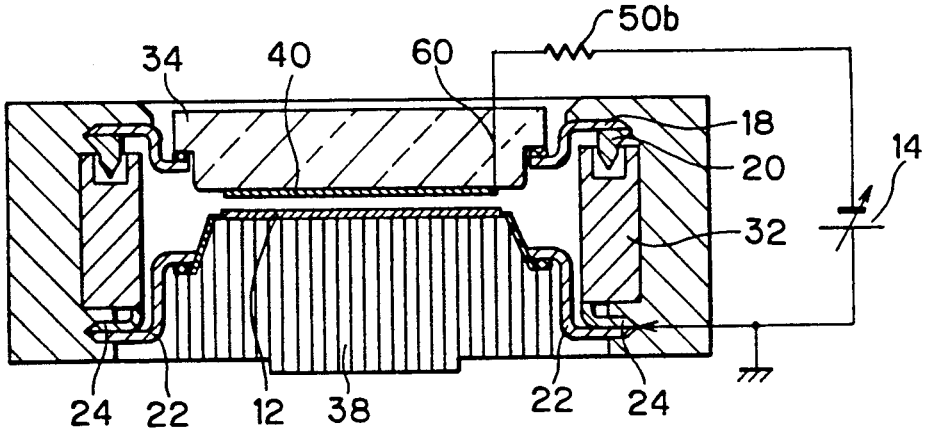
FIG. 3 is a cross-sectional view showing a proximity image intensifier according to still another embodiment of the present invention.

While the resistor for suppressing an excessive photoelectric current is inserted between the photocathode and the flange in the above embodiment, the present invention is not limited to such arrangement. The resistor for suppressing an excessive photoelectric current may be inserted in the power supply path for applying a high voltage from the high-voltage power supply to the photocathode at a position immediately before the photocathode. For example, as shown in FIG. 3, a resistor 50b whose resistance may be 1 GΩ, for example, for suppressing an excessive photoelectric current may be provided externally of the proximity image intensifier. Specifically, the electrically conductive layer 21 shown in FIG. 2A is dispensed with, and the resistor 50b is connected at one terminal to an end of the photocathode 40 through a pin-like joint conductor 60 extending through the faceplate 34, and at the other terminal to the negative terminal of the high-voltage power supply 14. With this construction, since the flanges 18, 20, 22, 24 are not involved in the buildup of the electrostatic resistance between the photocathode 40 and the phosphor screen 12, the electrostatic capacitance between the photocathode 40 and the phosphor screen 12 may further be reduced.

In the above embodiments, the photocathode is of the circular shape smaller than the conventional shape and slightly larger than the effective portion for photoelectrically converting the applied optical image in order to greatly reduce the substantial electrostatic capacitance between the photocathode and the phosphor screen. However, the present invention is not limited to the illustrated structure. The photocathode may be of the same size as the conventional photocathode, and at least the resistor for suppressing an excessive photoelectric current may be inserted in the power supply path for applying a high voltage from the high-voltage power supply to the photocathode at a position immediately before the photocathode.

In the above embodiments shown in FIGS. 2A, 2B, 2C and 3, the photocathode is of the circular shape slightly larger than the effective portion for photoelectrically converting the applied optical image, and the resistor for suppressing an excessive photoelectric current is inserted in the power supply path for applying a high voltage from the high-voltage power supply to the photocathode at a position immediately before the photocathode. The present invention is not limited to such arrangement. The resistor for suppressing an excessive photoelectric current may be inserted in the power supply path for applying a high voltage from the high-voltage power supply to the photocathode and the phosphor screen at a position immediately before at least one of the photocathode and the phosphor screen. For example, the resistor for suppressing an excessive photoelectric current may be inserted in the power supply path for applying a high voltage from the high-voltage power supply to the phosphor screen at a position immediately before the phosphor screen. With such an alternative, the phosphor screen may be composed only of an effectively portion thereof for thereby reducing the electrostatic capacitance and suppressing an excessive photoelectric current, as with the photocathode in the illustrated embodiments.

As described above, the proximity image intensifier according to the present invention includes the resistor for suppressing an excessive photoelectric current, the resistor being inserted in the power supply path for applying the high voltage from the high-voltage power supply at a position immediately before at least one of the photocathode and the phosphor screen, so that the effect of the electrostatic capacitance between the flanges is eliminated. Therefore, the electrostatic capacitance between the photocathode and the phosphor screen can be reduced smaller than the electrostatic capacitance in the conventional image intensifier which has included the electrostatic resistance between the flanges. Therefore, the charge stored by the electrostatic capacitance is reduced protecting the photocathode and the phosphor screen from burnout due to a spot of incident light. In the case where the area of the photocathode or the phosphor screen is slightly larger than the effective portion thereof and smaller than the conventional area, the electrostatic capacitance between the photocathode and the phosphor screen is further reduced for the reliable prevention of burnout of the phosphor screen in the event of a spot of intensive light falling on the photocathode.

What is claimed is:

1. A proximity image intensifier for intensifying an optical image, comprising:

a faceplate having a surface for receiving the optical image and another surface;

a photocathode fixed to the another surface of said faceplate for photoelectrically converting the optical image and producing photoelectrons;

a fiberplate having a surface closely disposed in confrontation with said photocathode;

a phosphor screen fixed to the surface of said fiberplate for receiving the photoelectrons from said photocathode and producing an intensified optical image thereon;

a high-voltage power supply for applying a high voltage necessary for accelerating the photoelectrons moving toward said phosphor screen;

a power supply path connected between said photocathode and said high-voltage power supply and between said phosphor screen and said high-voltage power supply for connecting said high-voltage power supply across said photocathode and said phosphor screen; and a resistor interposed in said power supply path at a position immediately before at least one of said photocathode and said phosphor screen for suppressing an excessive photoelectric current which may flow between said photocathode and said phosphor screen when highly intensive light is locally incident on the surface of said faceplate.

2. A proximity image intensifier according to claim 1, further comprising an electrically conductive member for supporting said faceplate, and wherein said photocathode is connected to said resistor which in turn is connected to said high-voltage power supply through said electrically conductive member.

3. A proximity image intensifier according to claim 2, wherein said photocathode has an effective area determined corresponding to an area of said phosphor screen from which the intensified optical image is to be picked up, an entire area of said photocathode being of a size larger than the effective area by a predetermined minimum.

4. A proximity image intensifier according to claim 2, wherein said resistor is formed on the another surface of said faceplate.

5. A proximity image intensifier according to claim 4, wherein said photocathode and said resistor are integrally deposited on the another surface of said faceplate by evaporation.

6. A proximity image intensifier according to claim 1, wherein said photocathode has an effective area determined corresponding to an area of said phosphor screen from which the intensified optical image is to be picked up, an entire area of said photocathode being of a size larger than the effective area by a predetermined minimum, and wherein said effective area of said photocathode is connected to said high-voltage power supply through said resistor.

7. A proximity image intensifier for intensifying an optical image, comprising:

a faceplate having a surface for receiving the optical image and another surface having a predetermined area;

a photocathode having an area smaller than the predetermined area and fixed to the another surface of said faceplate for photoelectrically converting the optical image and producing photoelectrons;

a fiberplate having a surface closely disposed in confrontation with said photocathode, the surface of said fiberplate having an area substantially equal to the predetermined area;

a phosphor screen fixed to the surface of said fiberplate for receiving the photoelectrons from said photocathode and producing an intensified optical image thereon;

a high-voltage power supply for applying a high voltage necessary for accelerating the photoelectrons moving toward said phosphor screen;

a power supply path connected between said photocathode and said high-voltage power supply and between said phosphor screen and said high-voltage power supply for connecting said high-voltage power supply across said photocathode and said phosphor screen; and a resistor interposed in said power supply path at a position immediately before at least one of said photocathode and said phosphor screen for suppressing an excessive photoelectric current which may flow between said photocathode and said phosphor screen when highly intensive light is locally incident on the surface of said faceplate.

8. A proximity image intensifier according to claim 7, further comprising an electrically conductive member for supporting said faceplate, and wherein said photocathode is connected to said resistor which in turn is connected to said high-voltage power supply through said electrically conductive member.

9. A proximity image intensifier according to claim 7, wherein said resistor is formed on the another surface of said faceplate.

10. A proximity image intensifier according to claim 9, wherein said photocathode and said resistor are integrally deposited on the another surface of said faceplate by evaporation.

* * * * *